US006604932B2

(12) United States Patent
Hagenmeyer

(10) Patent No.: US 6,604,932 B2
(45) Date of Patent: Aug. 12, 2003

(54) FOUR-BAR LINKAGE FOR MOVABLY SUPPORTING AN UPPER MOLD TOOL

(75) Inventor: Cord-Hermann Hagenmeyer, München (DE)

(73) Assignee: BBG Braunsberger GmbH & Co. KG, Mindelheim (DE)

( * ) Notice: Subject to any disclaimer, the term of this patent is extended or adjusted under 35 U.S.C. 154(b) by 0 days.

(21) Appl. No.: 09/829,440

(22) Filed: Apr. 10, 2001

(65) Prior Publication Data

US 2001/0028901 A1 Oct. 11, 2001

(30) Foreign Application Priority Data

Apr. 10, 2000 (DE) ..... 100 17 315

(51) Int. Cl.[7] ..... B29C 45/64
(52) U.S. Cl. ..... 425/450.1; 425/589
(58) Field of Search ..... 425/592, 593, 425/595, 409, DIG. 128, 188, 190, 450.1, 589

(56) References Cited

U.S. PATENT DOCUMENTS 1,992,314 A * 2/1935 Laussuco ..... 264/275
2,167,876 A * 8/1939 Coseboom ..... 425/116
3,577,591 A * 5/1971 Ricards et al. ..... 100/271
3,915,617 A * 10/1975 Saladin ..... 425/301
4,007,679 A * 2/1977 Edwards ..... 100/231
4,072,458 A * 2/1978 Schlieckmann ..... 425/451.6
4,360,335 A * 11/1982 West ..... 100/257
5,056,999 A * 10/1991 Lewis et al. ..... 100/233
5,462,421 A * 10/1995 Stein et al. ..... 425/127
6,113,382 A * 9/2000 McNally ..... 425/405.1
6,206,676 B1 * 3/2001 McNally ..... 425/214

* cited by examiner

*Primary Examiner*—Robert Davis
*Assistant Examiner*—Joseph S. Del Sole
(74) *Attorney, Agent, or Firm*—Nixon Peabody LLP; David S. Safran

(57) ABSTRACT

A device for supporting an upper mold tool (7) for movement with respect to a lower mold tool (25). Compared to known devices with simple pivoting supports, in which the space conditions for handling the workpieces with the mold tool opened are very restricted, the upper mold tool (7) is supported on a frame (1) by means of a multi-bar mechanism, such as a four-bar mechanism (10, 11) or a six-bar mechanism to provide a very wide opening of the space between the two mold tools.

9 Claims, 1 Drawing Sheet

FOUR-BAR LINKAGE FOR MOVABLY SUPPORTING AN UPPER MOLD TOOL

BACKGROUND OF THE INVENTION

1. Field of the Invention

The invention relates to a device for movably supporting an upper mold tool with respect to a lower mold tool.

2. Description of Related Art

In two-part mold tools, it is known that the upper mold tool can be moved by means of a simple pivoting drive from a closed working position, in which the upper mold tool and the lower mold tool are closed for production of workpiece in them by injection or casting, into an open feed position and a removal or maintenance position in which the upper mold tool is held at a distance above the lower mold tool for inserting casting inserts, for removing the finished workpiece and/or for cleaning the mold.

The defect in this configuration is that the space between the mold tools, especially when the workpieces are large, is only very poorly accessible. To some extent, this defect is remedied by a second drive enabling horizontal displacement of the top mold tool in addition to the pivoting motion. However, this greatly increases the complexity, and thus, the costs of such a device.

SUMMARY OF THE INVENTION

The primary object of this invention is to devise a device in which much better accessibility is enabled with simultaneously economical production.

This object is achieved by the upper mold tool being supported on a frame by means of a multi-bar mechanism, such as a four-bar mechanism or a six-bar mechanism The significance of the invention is that, by the upper mold tool being mounted on a frame by means of a four-bar mechanism or a multi-bar mechanism, the resulting path of movement of the upper mold tool produces a very wide opening of the space between the two mold tools.

According to one advantageous embodiment, it is provided that the upper mold tool is coupled to a vertically extending part of the frame by means of a tension rod and a triangular lever. Here, a leg of the triangular lever in conjunction with the tension rod forms a four-bar mechanism, and a drive for producing a pivoting motion is coupled to the another corner of the triangular lever.

Advantageously, the ratio of the work arm to the power arm on the triangular lever is roughly two to one. In this way, a relatively large swinging path of the upper mold tool can be achieved with a small actuating path of the drive.

Preferably, the lower mold tool is also pivotally mounted on the frame. This enables an ergonomically advantageous position for removing the workpieces and for cleaning the mold.

One embodiment of the invention is described in detail below, by way of example only, with reference to the accompanying the drawings.

BRIEF DESCRIPTION OF THE DRAWINGS

The sole FIGURE of the drawings shows a side view of the device in accordance with the invention with the mold tool opened.

DETAILED DESCRIPTION OF THE DRAWINGS

Figure 1:
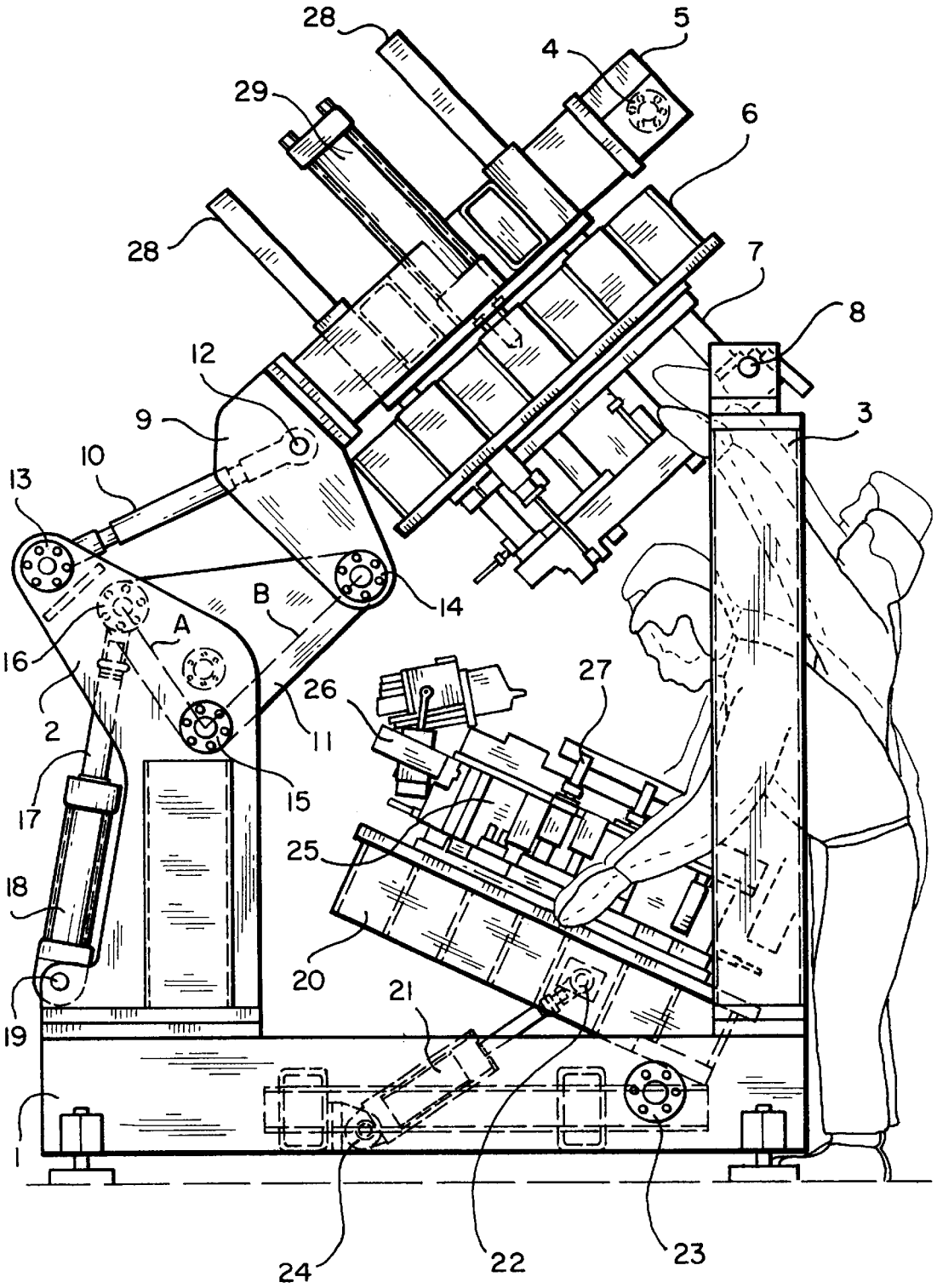

FIG. 1 shows a device for supporting an upper mold tool 7 for movement relative to a lower mold tool 25, with the mold tools in an open position. The device has a frame 1 which is composed of a slab-like machine foundation, a pair of side walls 2 attached vertically thereto, and vertical supports 3 located opposite the side walls 2.

A triangular lever 11 is pivotally mounted on the side walls 2 by means of a bearing 15. This triangular lever 11 is connected to the top end of a piston rod 17 on its top left corner in the area of a coupling 16. Piston rod 17 reciprocates in a hydraulic cylinder 18, a bottom end of which is hinged to the side wall 2 at a coupling 19 that is located near the slab-shaped lower part of the frame 1.

Furthermore, a tension rod 10 is coupled to the side walls 2 by a hinge 13; the other end of the tension rod 10 is attached to the coupling plate 9 of the upper mold tool in the by hinge 12. Also, the right outer end of the triangular lever 11 is attached to the coupling plate 9 by a hinge 14. The leg which extends between the bearing 15 and the coupling 14 (working arm B represented by a dot-dash line) together with the tension rod 10 form a four-bar mechanism. The four-bar mechanism is driven by a drive formed by the hydraulic cylinder 18. The distance of the coupling 16 of the piston road 17 to the bearing 15 forms a power arm A (represented by a dot-dash line) on the triangular lever 11. The ratio of the power arm A to the work arm B is preferably roughly one to two so that a relatively short actuating path of the hydraulic cylinder 18 and a relatively large pivoting motion of the top mold tool can be achieved.

The upper mold tool 7 is attached by means of an upper fixing plate 6 to the upper mold support 5 which, for its part, is flanged to the coupling plate 9. On the upper mold support 5 is a lifting cylinder 29 which is made as a hydraulic cylinder, with a piston which is attached by its lower end to the fixing plate 6. By means of this lifting cylinder 29, the fixing plate 6, with the upper mold tool 7, can be linearly moved along guides 28 relative to the upper mold support 5.

On the upper mold support 5, there is a lock 4 in the form of a pin which can be moved perpendicular to the plane of the drawing and which, when the upper mold support 5 is swung down, can engage a locking hole 8 on the top end of the supports 3.

The entire tool also includes a lower mold tool 25 which is attached to the lower fixing plate 20 which, for its part, is pivotally mounted on a frame 1 by means of a bearing 23. By means of a hydraulic cylinder 21, which has a bottom end attached by a coupling 24 to the frame 1 and a top end of an extendible piston rod which is attached by a coupling 22 to the lower fixing plate 20 so that the lower fixing plate 20 can be swung out of the feed and removal and/or maintenance position shown in FIG. 1 into the working position in which the lower mold tool 25 is parallel to the lower plate of the frame 1.

On the lower mold tool 25, if necessary, there is a slide valve gear 26 which can actuate slide valves to produce undercuts on the workpiece. Ejectors 27 facilitate the lifting of the finished workpiece from the lower mold tool 25.

By means of the wide pivoting motion which is produced by the four-bar mechanism 10, 11, the mold tool in the feed and removal and/or maintenance position (FIG. 1) is opened to such an extent that the operator has unhindered access. Likewise, by means of a robot, the insertion of casting inserts and removal of the finished workpiece can take place unhindered. The pivoting motion of the lower mold tool 25 also facilitates access.

In the working position, the hydraulic cylinder 21 is retracted and the lower mold tool 25 assumes a horizontal position. The upper mold tool 7 is swung down by means of the four-bar mechanism by the hydraulic cylinder and the lock is engaged to the locking hole 8. Thereupon, by means of the lifting cylinder 29 the upper mold tool 7 is lowered onto the lower mold tool 25 and pressed securely against it. At this point, injection means (not shown) force liquid plastic into the molds, and in this way, the workpiece is produced. Then, the upper mold tool 7 is raised by means of the lifting cylinder 29, the lock 4 is released and the upper mold tool 5 swung up by means of the four-bar mechanism 10 and 11. Optionally, the lower mold tool 25 can be tilted into the oblique position which is shown in FIG. 1 and after actuating the slide valve gear 26 and the ejector 27, the finished workpiece is removed, the mold is cleaned if necessary and casting inserts optionally inserted for producing the next workpiece.

Instead of the described four-bar mechanism 10 and 11, a multi-bar mechanism, such as a six-bar mechanism, can also be used to advantage for producing a pivoting motion of the upper mold tool.

What is claimed is:

1. Device for supporting an upper mold tool for movement with respect to a lower mold tool, wherein the upper mold tool is supported on a frame by means of a four-bar linkage, said four-bar linkage comprising two levers, each of which is pivotally mounted at one end to a bearing on said frame and is coupled at an opposite end to a coupling plate of the upper mold tool.

2. Device as claimed in claim 1, wherein one of said levers is a triangular lever.

3. Device as claimed in claim 2, wherein a drive for producing pivoting motion is coupled to the triangular lever.

4. Device as claimed in claim 3, wherein the drive comprises a hydraulic cylinder.

5. Device as claimed in claim 2, wherein a distance on the triangular lever from a bearing connecting the triangular lever to the frame to a joint connecting the triangular lever to the upper mold tool is roughly twice the distance from said bearing to a coupling of the drive to the triangular lever.

6. Device as claimed in claim 2, wherein the lower mold tool is pivotally mounted on the frame.

7. Device as claimed in claim 2, wherein a lock is provided on the upper mold tool by which the upper mold tool is lockable relative to the frame for performing of a molding process.

8. Device as claimed in claim 7, wherein an operating mechanism for the lock and the drive which produces motion of the upper mold tool are coupled to a common control.

9. Device as claimed in claim 7, further comprising an upper mold support; wherein the upper mold is supported to move vertically on the upper mold support by a lifting cylinder.

* * * * *